United States Patent [19]

Gauer et al.

[11] 4,254,641

[45] Mar. 10, 1981

[54] AUTOMATIC WASHER BASKET BRAKE MECHANISM

[75] Inventors: Joseph A. Gauer, Buchanan Township, Berrien County; William L. Kennedy, Coloma Township, Berrien County, both of Mich.

[73] Assignee: Whirlpool Corporation, Benton Harbor, Mich.

[21] Appl. No.: 39,117

[22] Filed: May 15, 1979

[51] Int. Cl.[3] ..... D06F 37/40

[52] U.S. Cl. ..... 68/23.7; 188/166; 188/325; 192/12 B; 210/368

[58] Field of Search ..... 68/23 R, 23.6, 23.7; 210/368; 192/12 R, 12 B; 188/166, 325, 332, 333

[56] References Cited

U.S. PATENT DOCUMENTS

| | | | |
|---|---|---|---|
| 1,666,275 | 4/1928 | Walsh | 192/144 |
| 1,676,087 | 7/1928 | Herborn | 192/12 R |
| 1,877,694 | 9/1932 | Ryan | 192/144 |
| 1,975,206 | 10/1934 | Fuhrman | 192/12 R X |
| 2,497,686 | 2/1950 | Young et al. | 68/23.7 X |
| 2,512,847 | 6/1950 | Conterman | 192/12 R X |
| 2,639,618 | 5/1953 | McNairy | 68/23.7 X |
| 2,844,225 | 7/1958 | Hubbard et al. | 68/23.7 X |
| 2,845,156 | 7/1958 | Dayton | 68/23.7 X |
| 2,933,913 | 4/1960 | Fields | 68/23.7 |
| 2,946,409 | 7/1960 | Jennings | 68/23.7 X |
| 3,040,854 | 6/1962 | Rauh | 192/45.1 |
| 3,100,030 | 8/1963 | McMillan | 68/23.7 X |
| 3,243,021 | 3/1966 | Pelensky | 68/23.6 X |
| 4,165,624 | 8/1979 | Ruble | 68/23.7 |

*Primary Examiner*—Philip R. Coe

*Attorney, Agent, or Firm*—Hill, Van Santen, Steadman, Chiara & Simpson

[57] ABSTRACT

A spin brake and brake release mechanism for an automatic washer or other spinning drive mechanism has a pair of brake shoes applied by a spring but released by a rotating cam mechanism. The brake operating mechanism rotates with the spin basket. The brake drum is connected to the stationary parts of the machine. As the release cam rotates, it acts against cam follower areas of the brake shoes to release the shoes from the drum.

22 Claims, 10 Drawing Figures

22

31
30
34
33
40
102
101
100
21
41
26
19
25
35
36
43A
37
43
43A
23
32
42

AUTOMATIC WASHER BASKET BRAKE MECHANISM

BACKGROUND OF THE INVENTION

1. Field of the Invention

The present invention relates to a laundry appliance and more particularly to a brake mechanism for a spin basket.

2. Description of the Prior Art

Brake mechanism for a laundry appliance to stop rotation of a spin basket should loss of input power occur are shown in U.S. Pat. Nos. 2,639,618; 2,845,156 and 2,844,225. U.S. Pat. No. 2,639,618 discloses a laundry appliance brake having brake shoes which are pivotable about a common point. U.S. Pat. No. 2,845,156 utilizes a brake band which is moved into frictional engagement with a portion of the spin basket by means of engagement with a single rotatable pawl. U.S. Pat. No. 2,844,225 also discloses a brake utilizing a continuous brake band which is also actuated by a single rotating pawl, however, the pawl rotates about an axis normal to the axis of rotation of the spin basket.

A gripping means comprising a number of pivotable pawls which are moved into engagement with a surface of rotation of an irregularly shaped cam which is rotated to bring the pawls into engagement with a surface to be rotated is disclosed in U.S. Pat. No. 3,040,854.

SUMMARY OF THE INVENTION

An automatic laundry appliance has a pre-set cycle of operation including an agitate or washing period portion and a spin or drying period portion. Clothes placed in a wash basket are moved about in wash liquid by means of an oscillating vertical agitator. During this agitate portion of the cycle of operation, the spin basket must remain stationary with respect to the agitator. At the end of the agitate portion of the cycle, the spin basket is rapidly rotated to centrifugally extract wash liquid or rinse water from the clothes. During this portion of the cycle, the spin basket rotates free of the brake mechanism. However, if a sudden loss of power occurs, for example, as a result of activation of a power cut-off switch by opening of the washer lid, rotation of the spin basket must be immediately braked for safety reasons.

The laundry appliance braking mechanism of the present invention has elements which are also elements of a drive train transmitting rotational motion from a drive motor to the spin basket. A spin collar having teeth thereon engages teeth of a spin gear which is rotated by the drive motor. The spin collar is clampingly engaged for co-rotation with a friction clutch. The clutch has vertical walls which frictionally engage a circumferentially expandable spring biased band inside the clutch. The spring provides a surface against which a downwardly extending arm of a cam abuts when the clutch is rotated. The cam is freely rotatable about a spin tube which is attached to the spin basket.

Mounted around the spin tube and above the clutch are a pair of brake arms pivotable about a common point and spring biased to normally frictionally engage a downwardly extending portion stationary with respect to the basket of the laundry appliance to prevent rotation of the spin basket. Each brake arm has a cam follower portion which abuts the cam so that when the cam is rotated the arms are moved out of frictional engagement with the stationary portion. A plate above the brake arms and attached to the common pivot point for co-rotation with the brake arms limits rotation of the cam and inward movement of the brake arms. The plate is connected to a spin tube for co-rotation with the spin basket so that when the cam releases the brake arms, rotational movement of the brake arms is transmitted to the spin basket. The drive train from the drive motor thus comprises the spin drive gear, the spin collar, the clutch, the cam, the brake arms, the plate and the spin tube to the spin basket.

If the spin drive gear slows or ceases its rotation due to a loss in power to the drive motor, the clutch will also slow or cease rotation, and the spring biasing the brake arms will cause the brake arms to return the cam to its original position and the brake arms will again engage the stationary portion to cease rotation of the spin basket.

DESCRIPTION OF THE PREFERRED EMBODIMENTS

Figure 1:
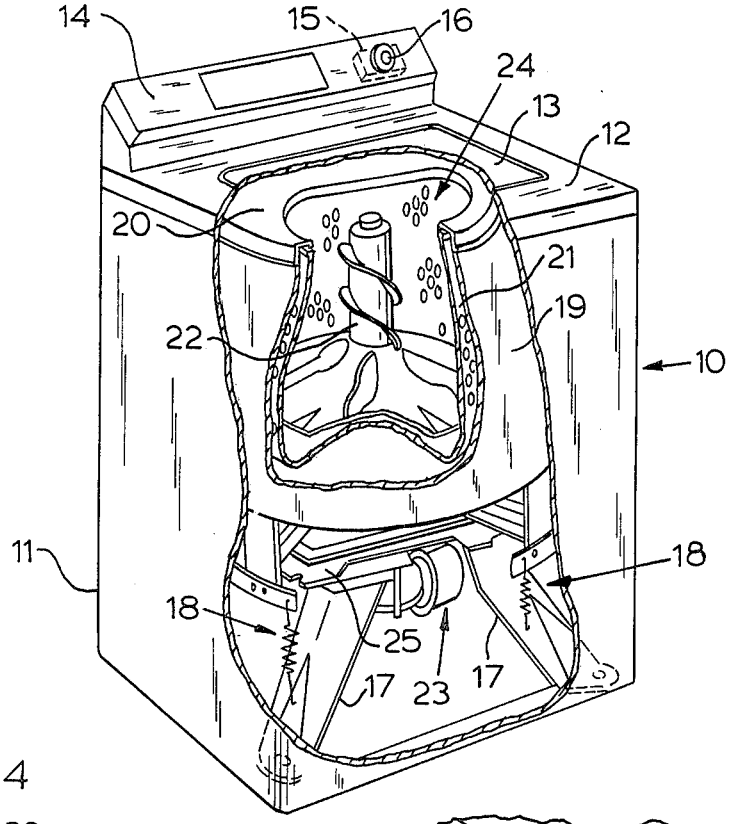
FIG. 1 is a perspective view, partly broken away, of an automatic laundry appliance embodying the present invention.

An automatic laundry appliance is generally illustrated in FIG. 1 at 10 as comprising a tub 19 which has a perforate clothes container or spin basket 21 contained in the tub 19 and an agitator 22 vertically disposed within the spin basket 21 and mounted for oscillatory movement with respect thereto. The basket 21 is mounted for spinning movement during centrifugal extraction of water from the clothes within the basket 21. The tub 19, the spin basket 21 and the agitator 22 and a drive mechanism 23 for the appliance are contained in a cabinet 11.

The cabinet 11 has a top 12 having a hinged lid 13 which is opened to afford access to a clothes-receiving opening 24 which is defined by a tub ring 20 extending about the tub and over a corresponding opening in the spin basket 21. The appliance 10 also has a suitable control means including a timer dial 16 connected to a timer 15 which is mounted on a control panel portion 14 of the cabinet 11. Suitable wiring connects the timer 14 to the drive mechanism 23 and to other electrical components of the appliance to control operation of a wash cycle including a wash portion and a spin portion. The timer dial 16 and the timer 15 may be mounted in any desired location and are shown in the present location for illustrative purposes only.

Figure 2:
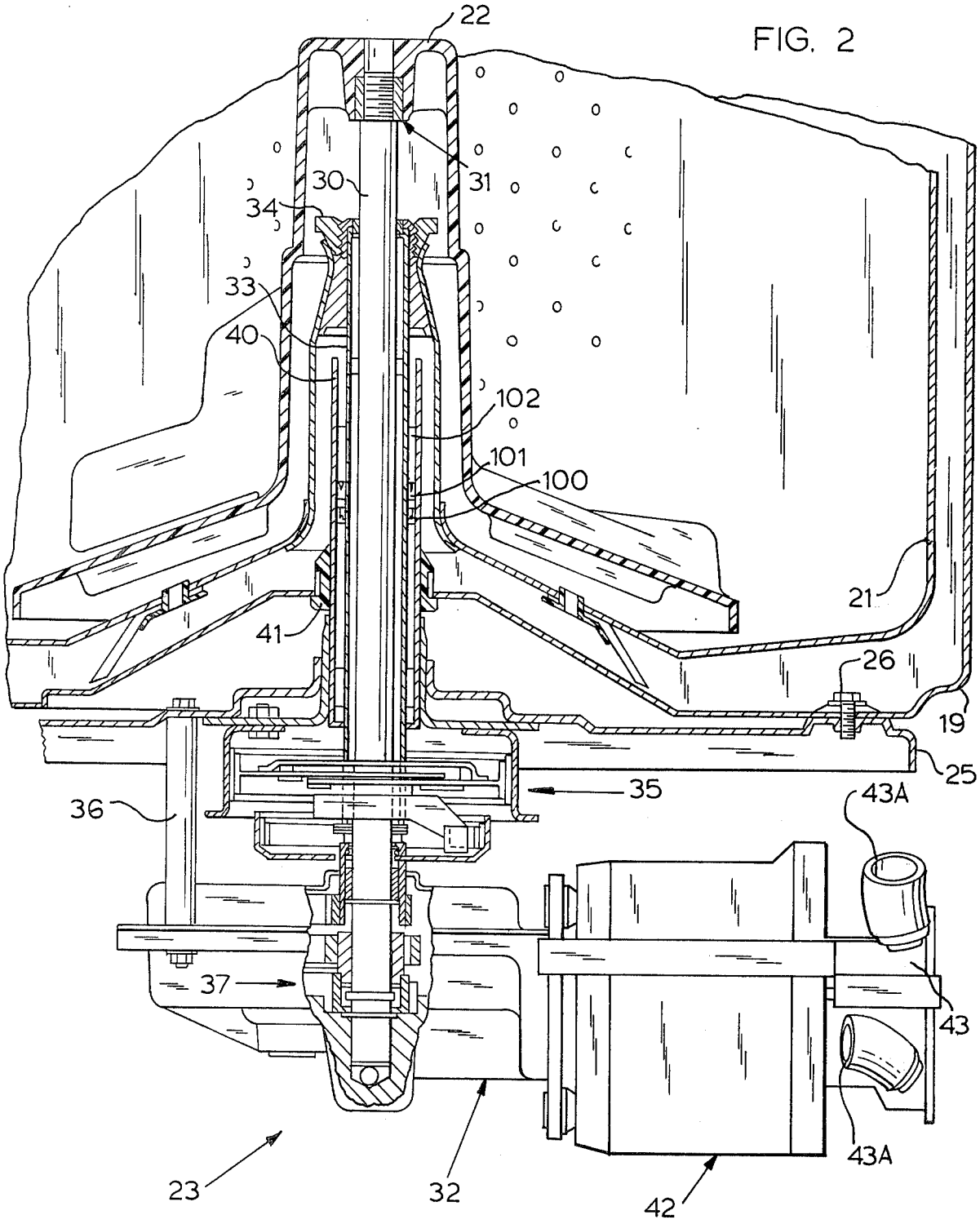
FIG. 2 is a fragmentary enlarged cross-sectional view of a portion of the appliance of FIG. 1.

All components inside the cabinet 11 are supported by struts 17, having a suspension system 18 connected thereto to minimize vibration. Referring to FIG. 2, the drive mechanism 23 also operates a liquid pump 43 having hoses 43A connected thereto. The drive mechanism 23, and other components such as the transmission housing 32 and the motor housing 42 are suspended from a mounting plate 25 by mounting means such as a bolt and sleeve arrangement 36. The tub 19 is also mounted to the mounting plate 25 by means of bolts such as 26. A grommet 41 maintains a watertight relation between the tub 19 and an agitator shaft encasement column 40. A brake mechanism 35 operates in association with an agitator shaft 30 and a spin tube 33, and is mounted to the mounting plate 25. The brake mechanism 35 is shown in greater detail in FIGS. 3, 5, 6, 7 and 8.

The agitator 22 is attached to the agitator shaft 30 by threaded attachment means 31 and the spin basket 21 is attached to the spin tube 33 by a drive block and nut attachment means 34.

Figure 3:
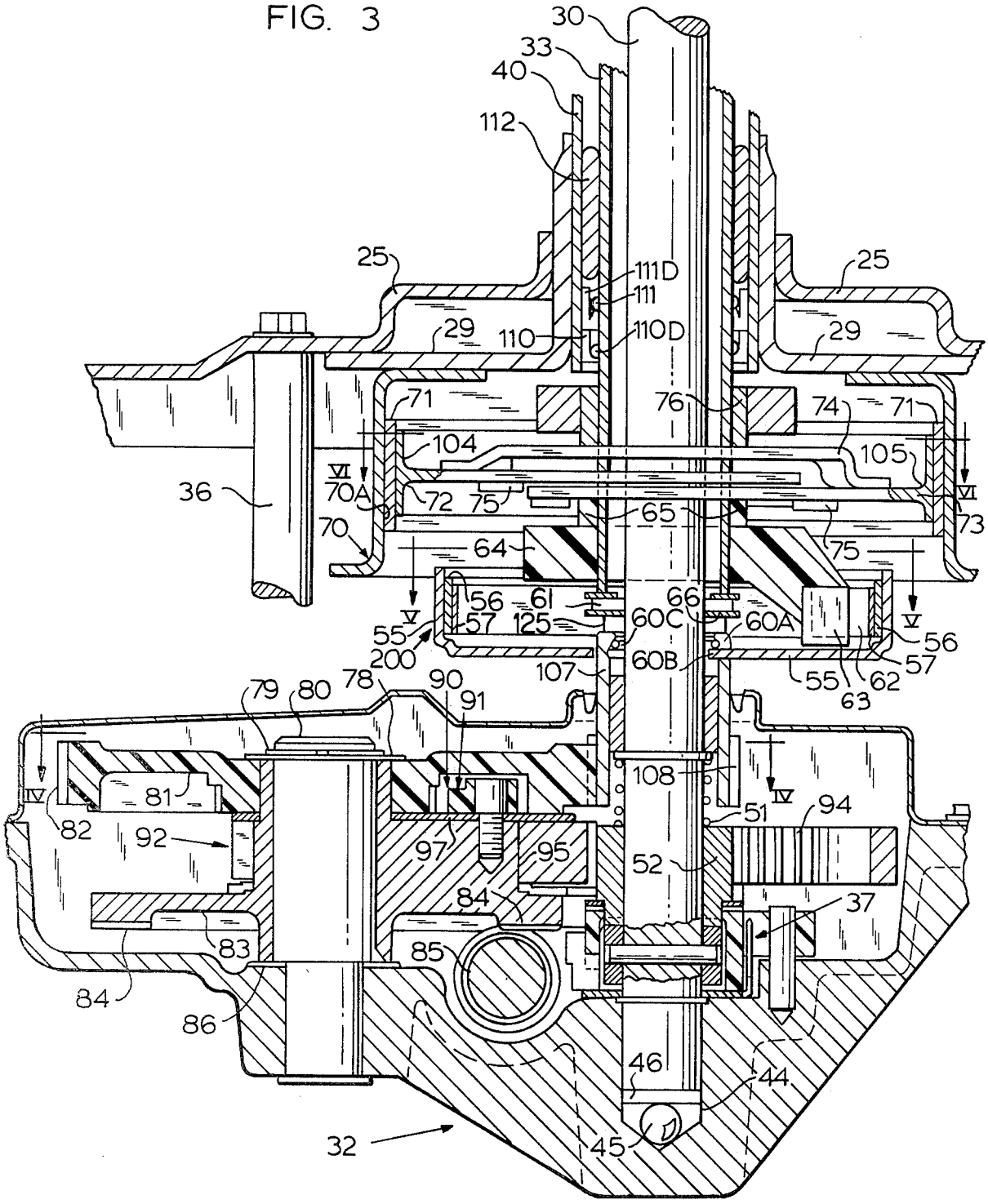
FIG. 3 is a fragmentary enlarged cross-sectional view showing additional details of the structure of FIG. 2.

As shown in greater detail in FIG. 3, a seal between the spin tube 33 and the agitator encasement column 40 is provided by a bearing 112 and a pair of seals 111 and 110. The seals 110 and 111 have lips 110D and 111D respectively on an inner surface thereof to form a lip seal between the rotatable spin tube 33 and stationary encasement column 40. A reinforcement member 29 is disposed between the agitator encasement column 40 and the base plate 25 and is rigidly affixed to the column and the plate. A circular dish-like member 70 is attached to the underside of the reinforcement member 29 and extends downwardly therefrom. Thus, the dish 70, the reinforcement member 29, the agitator encasement column 40 and the mounting plate 25 are all stationary with respect to the agitator shaft 30 and spin tube 33.

Oscillatory motion is imparted to the agitator 22 by the agitator shaft 30 during a wash portion of a cycle of operation as follows. A drive motor contained in the motor housing 42 has a drive shaft 120 (FIG. 4) which rotates a worm gear 85 disposed beneath a main drive gear 83 in the transmission housing 32. Referring again to FIG. 3, the worm gear engages teeth 84 on a lower surface of the drive gear 83 to rotate the gear 83 about a vertical jack shaft 80. The jack shaft 80 is parallel to the agitator shaft 30. The agitator shaft 30 is received in a receptacle 44 in the housing 32 and rotates on a bearing 45 and a bearing surface 46. An eccentric 95 is integrally formed on an upper surface of the main drive gear 83.

Figure 4:
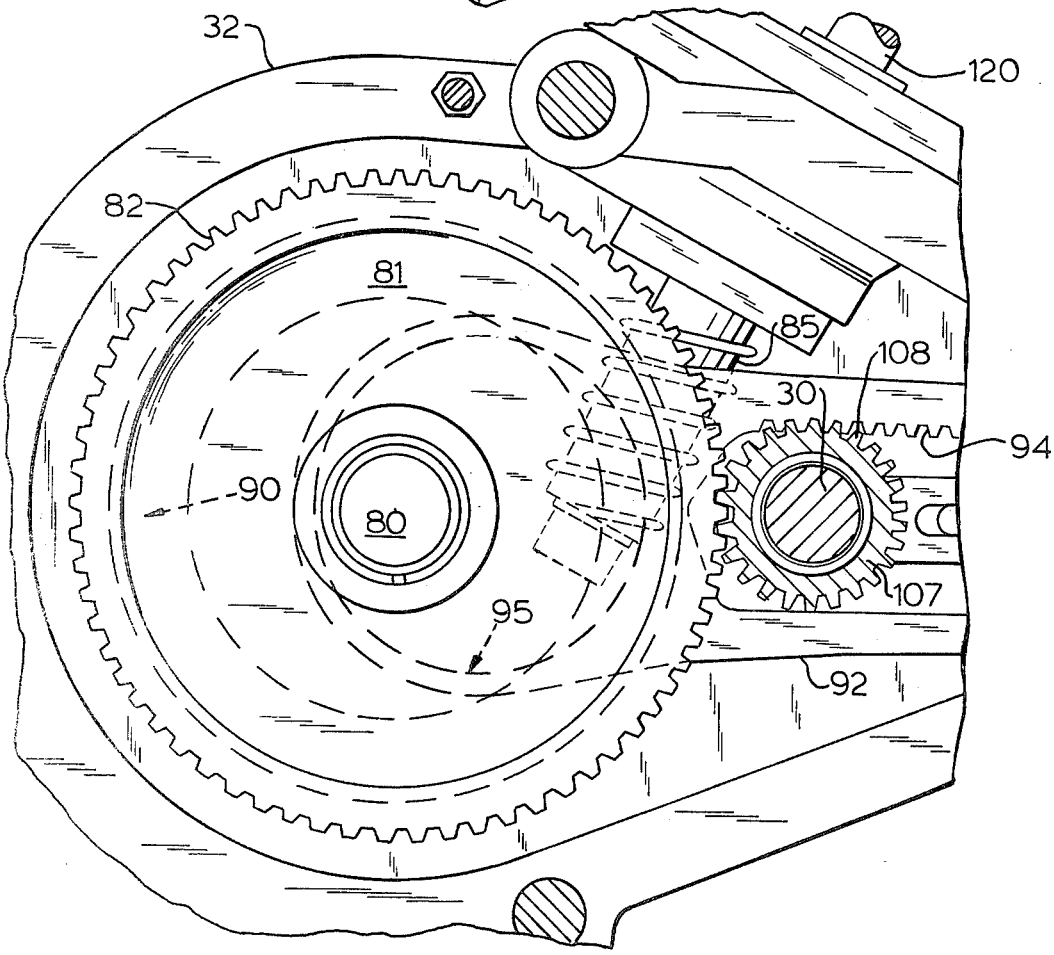
FIG. 4 is a sectional view taken on line IV—IV of FIG. 3.

As best shown in FIGS. 3 and 4, a rack 92 has a first end which is carried in mating relationship with the eccentric 95 and a second end which surrounds the agitator shaft 30. The second end has teeth 94 thereon which engage teeth on a circumference of a pinion 52 (FIG. 3). The pinion 52 is freely rotatable about the agitator shaft 30, and a clutch means 37 selectively engages the pinion with the shaft 30 for co-rotation therewith. The rack 92 is moved in reciprocating motion by the eccentric 95 in a plane normal to the agitator shaft 30, so that the reciprocating motion is transferred to the shaft 30 through pinion 52 and clutch 37, oscillating the agitator 22. During this portion of the cycle of operation, the spin basket 21 is maintained stationary relative to the cabinet 11 as described below.

After the wash portion of the operation cyle has ended the clutch means 37 is disengaged so that the agitator shaft 30 is no longer drivingly connected to the drive gear 83. Disengagement of the clutch means 37 requires one complete rotation of the main gear 83, and a delay mechanism 91 is mounted on a bearing plate 97 on the main gear 83 to provide such a delay. The delay mechanism 91 rotates on the eccentric 95 in a channel 90 in a bottom surface of a spin gear 81.

The spin gear 81 is also mounted on the jack shaft 80 and is rotated with main drive gear 83 when the delay mechanism 91 is in engagement. All elements are maintained in adjacent relationship on the jack shaft 80 by means of a bearing washer 78 held in place by a snap ring 79.

The spin gear 81 has teeth 82 on a circumference thereof which engage teeth 108 on a circumference of a spin collar 107 which surrounds the agitator 30.

The spin collar 107 is in co-rotational relation with a clutch or drive means 200 including a clutch member 55. The spin collar 107 has a vertical fluted end **60*a* on an upper portion interfitted with three drive lugs 60*b* (only one shown) of a central hub portion of the clutch member 55. An internal spring wire ring 60*c* in a groove in the collar 107 maintains the interfitted relationship of the collar and clutch member. A snap ring 125 is mounted on the agitator shaft 30 immediately above the fluted end 60*a*. A pair of bearing washers 66 and a thrust washer 61 rest on the snap ring 121 and also surround the agitator shaft 30, but are freely rotatable with respect thereto. The bottom of the spin tube 33 rests on an upper one of the bearing washers 66**.

Figure 5:
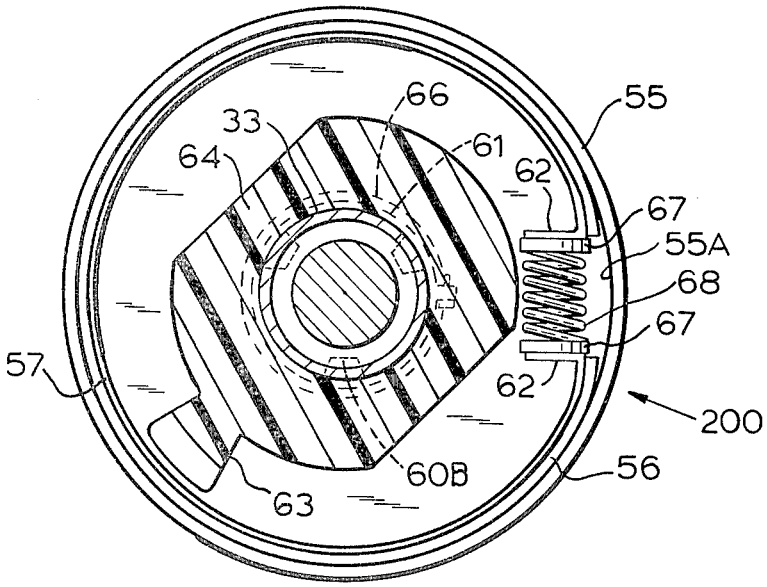
FIG. 5 is a sectional view taken on line V—V of FIG. 3.

The interior of the clutch member 55 is shown in detail in FIG. 5. A strip of glass filled teflon frictional material 56 is in frictional engagement with an inner surface 55A of a vertical wall of the clutch member 55 and is attached to a clutch band 57 which also extends around the interior of the clutch member 55. The clutch band 57 has two inwardly projecting ends 62 which abut a pair of caps 67 to receive ends of a biasing spring 68 to bias band 57 and material 56 against the interior wall 55A. A rotatable cam member 64, mounted coaxially with the agitator shaft and freely rotatable with respect thereto, has a lower arm 63 which extends into the interior of the clutch member 55 (See FIG. 3).

The clutch 200 is of the constant torque variety and operates as follows. Band 57 is rotated through frictional engagement with the rotating clutch member 55 until the end 62 of the band 57 contacts the lower arm 63 of cam member 64. The torque resulting from the resistance of the cam member 64, and its associated drive train members to be hereinafter described, increases as the clutch member 55 is driven against cam arm 63. As the torque increases the bias spring 68 is compressed, thereby shortening the diameter of the band 57 and reducing the frictional force exerted by frictional material 56 on the inner wall 55A of clutch member 55.

Figure 7:
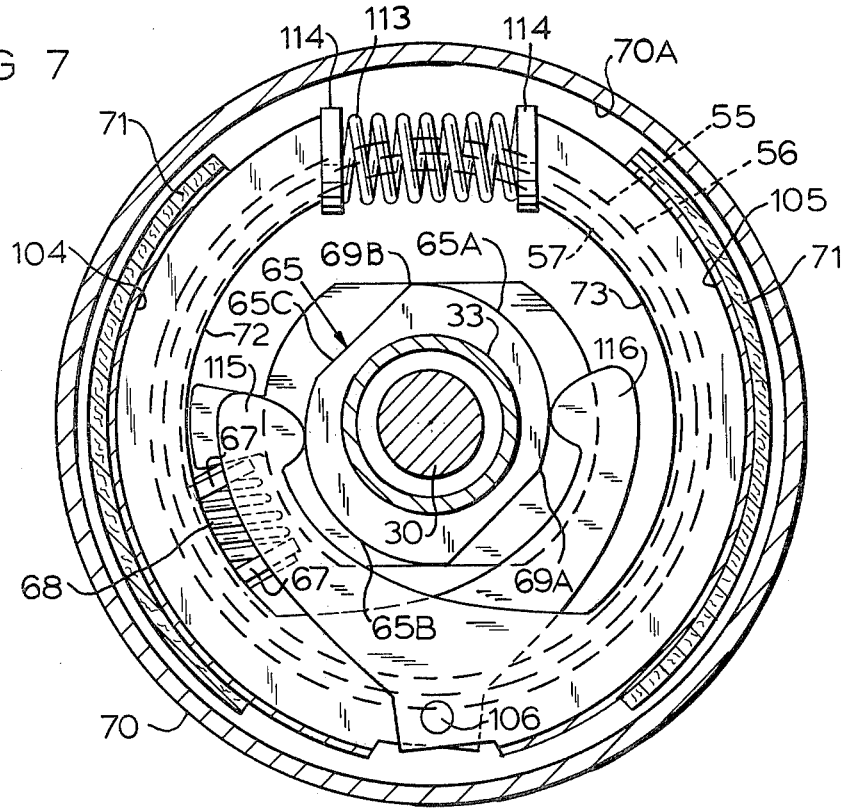
FIG. 7 is a sectional view taken along line VIII—VIII of FIG. 6.
Figure 8:
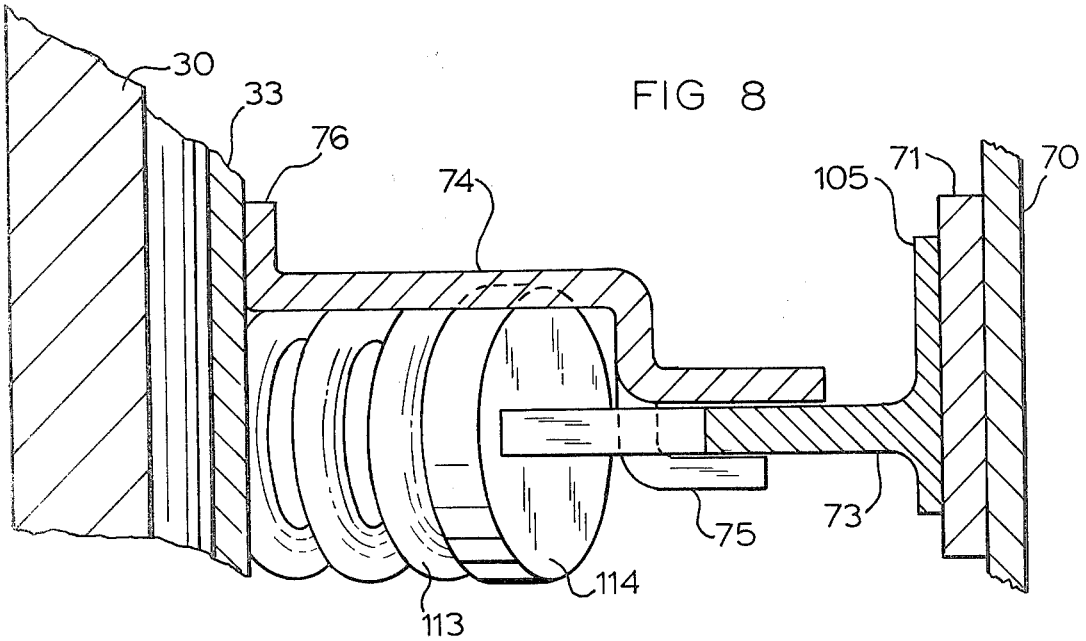
FIG. 8 is a sectional view taken along line VII—VII of FIG. 6.

When the torque exceeds the frictional force the material 56 and band 57 will slip relative to the inner wall 55A of clutch member 55. Therefore, only so much torque as is required to cause slippage between the frictional material and clutch member 55 is transmitted to the drive train beyond cam 64. At the beginning of the spin cycle, the torque required to rotate the arm 63 is at a maximum and slippage occurs as the engagement of the end 62 and arm 63 begins to drive the basket 21. As the basket 21 begins to rotate faster, the torque needed to rotate the basket becomes less, so that the frictional force provided by the spring 68 provides a torque equal to that required to rotate the basket 21 and the frictional material 56 and band 57 rotate with the clutch member 55. Referring to FIGS. 3 and 7, the cam member 64 has a cam 65 of generally oblong shape integrally mounted on the top thereof with two opposite camming surface portions 65A and 65B and two parallel surface portions 65C. The cam surface portions 65A and 65B are of the same shape and as shown on surface 65A increase in radial distance from the spin tube 33 from point 69A to point 69B. As shown in FIG. 3, the cam 65 extends upwardly between two brake members 72 and 73.

As shown in FIGS. 3 and 7, the brake members 72 and 73 are disposed in adjacent horizontal planes, normal to the agitator shaft 30. The brake members 72 and 73 each have vertically disposed outer shoes 104 and 105 respectively. The shoes each have attached thereto identical strips of frictional material 71. The brake members 72 and 73 can be pivotally moved to place the material 71 in frictional engagement with a vertical interior surface 70A of the dish 70. The brake members 72 and 73 pivot about a common pivot 106. Each brake member has an identical cap 114 at an end thereof which receives an end of a biasing spring 113. The spring 113 normally maintains the shoes 104 and 105 in frictional engagement with the vertical surface 70A.

Referring now to FIG. 7, the brake member 72 has a cam follower arm 116 and the brake member 73 has a cam follower arm 115 each of which abut the cam 65. When the cam 65 is rotated to the position shown in FIG. 7, the radial distance from spin tube 33 to the surface portions 65A and 65B increases and moves the arms 115 and 116 outwardly from the tube. This pivots the brake members 72 and 73 about the pivot 106 so that the shoes 104 and 105 are moved away from the wall 70A, disengaging the frictional strips 71 from the wall. When the cam 65 is rotated in an opposite direction so that the arms 115 and 116 abut the parallel surfaces 65C, the arms 115 and 116 are free to move closer together and are forced to do so by the biasing spring 113, so that the frictional material engages the inner wall 70A.

Figure 6:
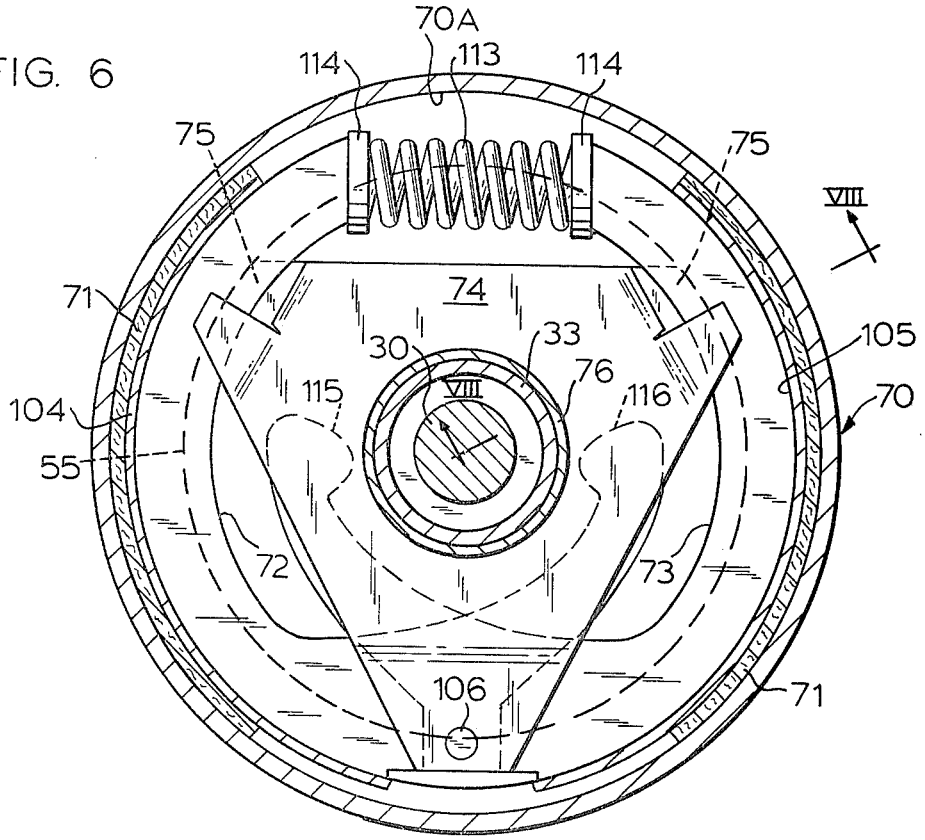
FIG. 6 is a sectional view taken on line VI—VI of FIG. 3.

As shown in FIG. 6, a plate 74 is disposed generally above the brake members 72 and 73 and parallel thereto. The pivot 106 extends upwardly into the plate 74. The plate 74 is rigidly attached along the flange 76, such as by welding, to the spin tube 33, so that the plate 74 and spin tube 33 are co-rotational. The plate 74 has downwardly extending tabs 75 which limit the inward movement of the brake members 72 and 73. Limiting the inward movement of the brake members 72 and 73 also limits the rotational movement of the cam 65, because the arms 115 and 116 prevent rotation of the cam 65 beyond a distance necessary to move the brake members 72 and 73 into contact with the tabs 75.

Operation of the brake mechanism is as follows. During an agitate portion of the wash cycle rotation of the worm 85 in one direction rotates main drive gear 83 so that the delay means 91 does not engage the spin gear 81. Thus, the spin gear 81, the spin collar 107, the clutch member 55, the expandable band 57 and the cam member 64 remain stationary. The parallel surface portions 65C of the cam surface 65 are adjacent the brake cam follower arms 115 and 116 so that the bias spring 113 maintains the shoes 104 and 105 are frictional material 71 against the wall 70A of the stationary dish 70. Through pivot 106 and plate 74, the spin tube 33 and thus the spin basket 21 are held stationary.

When, at the beginning of the spin portion of the cycle the direction of rotation of the motor and thus worm 85 is reversed under the control of timer 15, the delay means 91 engages the spin gear 81 so that the spin gear 81 rotates on the jack shaft 80. The teeth 82 on the spin gear 81 engage the teeth 108 to rotate the spin collar 107, which in turn rotates the clutch member 55.

Rotation of the clutch member 55 drives the band 57 in rotation through frictional material 56. As the band rotates, the end 62 thereof moves into engagement with the arm 63 on the cam member 64. The cam member 64 and the cam 65 mounted thereon are rotated by the band 57. The cam 65 rotates only a distance sufficient to move the brake arms 115 and 116 about the pivot 106 so that the brake members 72 and 73 abut the tabs 75 on the plate 74. The shoes 104 and 105 and frictional strips 71 are thus moved away from the dish 70 so that the spin basket 21 is free to rotate. The cam, fixed in the position shown in FIG. 7, continues to be rotated by the end 62 of the band 57. The brake members 72 and 73 and the plate 74 are in co-rotatable relation when the cam 65 is in such a position. Because the members 72 and 73 engage the tabs 75, and the pivot 106 extends through both brake members and the plate 74, the entire brake member-plate combination is rotated, causing the spin tube 33 which is attached to the plate 74 and the spin basket 21 to rotate.

In accordance with such operation, a drive train from the worm 85 to the spin basket 21 is completed comprising the main gear 83, the delay mechanism 91, the spin gear 81, the spin collar 107, the clutch member 55, the friction material 56 and band 57, the cam member arm 63, the cam member 64, the cam 65, the brake arms 115 and 116, the brake members 72 and 73, the plate 74 and the spin tube 33.

When the rotation of the main gear 83 slows or ceases rotation for any reason, such as a power shut-off due to an automatically opening switch activated by opening the washer lid 13, end 62 of the clutch band 57 separates from cam arm 63. The spring 113 then forces the brake arms 115 and 116 together again, rotating the cam 65 back into a position so that the parallel faces 65C are adjacent the brake arms 115 and 116. The shoes 104 and 105 and frictional strips 71 move against the dish inner wall 70A, thereby stopping rotation of the brake member-plate combination, so that the rotation of the spin tube 33 and spin basket 21 is also stopped.

Figure 9:
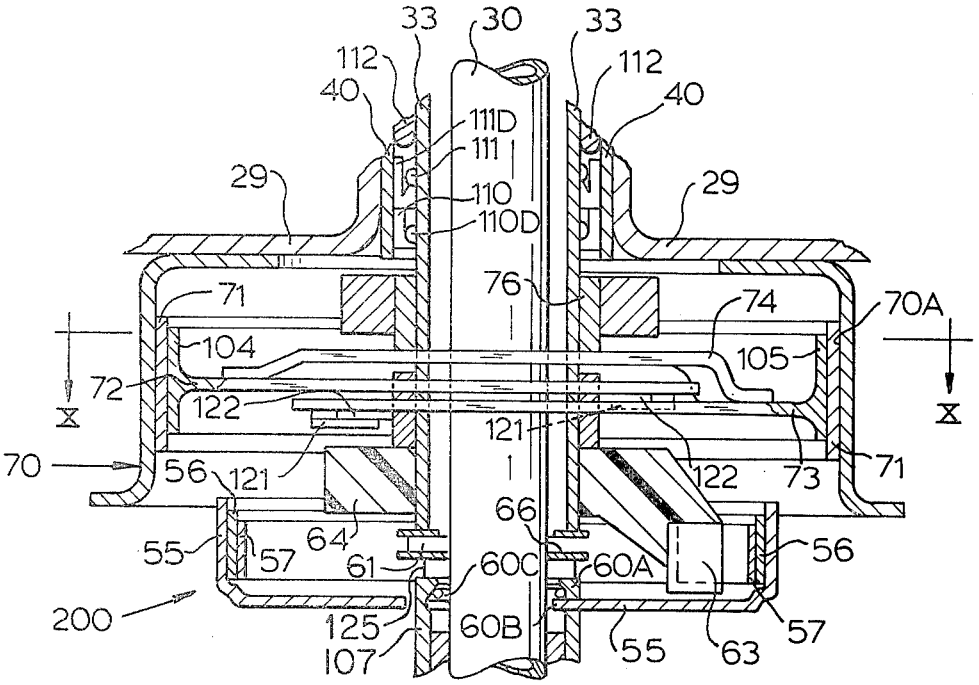
FIG. 9 is a partial view of FIG. 3 showing an alternate cam embodiment.
Figure 10:
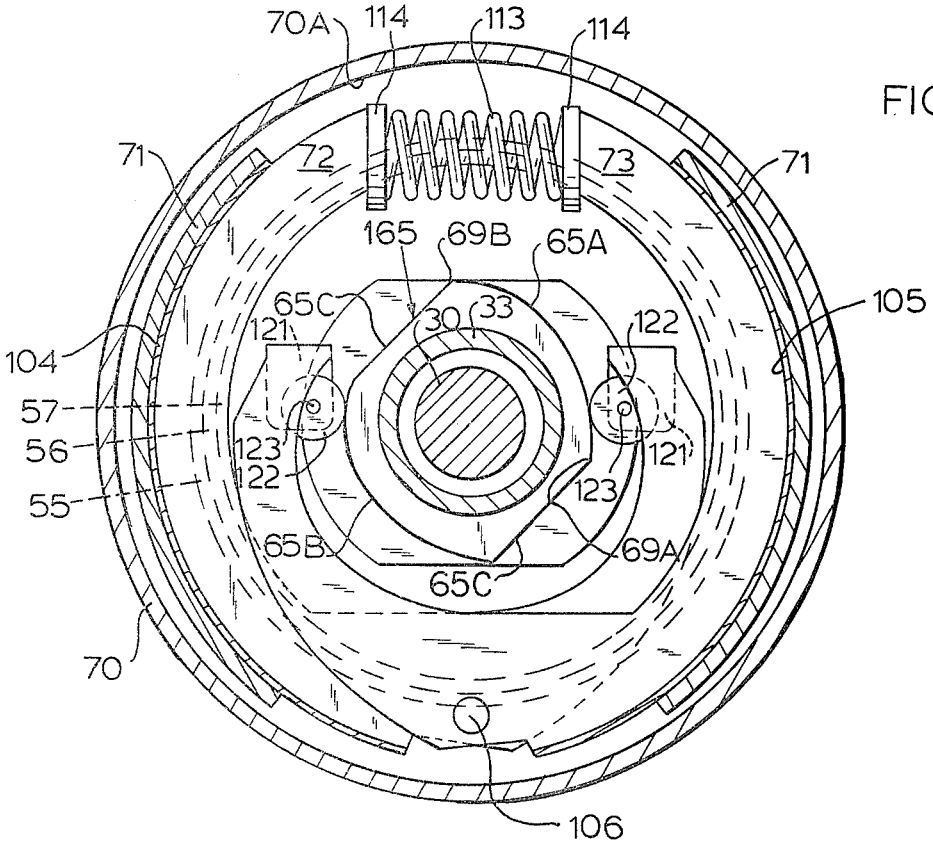
FIG. 10 is a view similar to FIG. 7 showing an alternate embodiment of a brake shoe arm.

An alternative form of the preferred embodiment of the clutch and brake mechanism is shown in FIGS. 9 and 10. The mechanism is basically the same as that previously described and the same reference numerals and therefore used for similar parts. The only modifications to the previously described mechanism are the addition of rollers to the cam follower arms 115 and 116 to provide less friction with the cam surfaces 65A and 65B which in this embodiment are metal. The rollers 122 are rotatably mounted on pins 123. The pins 123 are supported between the arms 115 and 116 and folded over tabs 121 respectively. Further, as shown in FIG. 10, the cam 165 is made of steel and set into the cam member 64. The shape of the cam surfaces on cam 165 are the same as those of cam 65. Thus, the cam follower arms 115 and 116 have rollers 122 riding on metal cam 165 to provide a more frictionless cam to cam follower interface.

Although changes and modifications of the present invention may be apparent to those skilled in the art, it should be understood we wish to include within the patent warranted hereon all such changes and modifications as may reasonably and properly be included within the scope of our contribution to the art.

The embodiments of the invention in which an exclusive property or privilege is claimed are defined as follows:

1. An automatic laundry appliance comprising:
a cabinet;
a rotatable spin basket mounted in said cabinet;
a vertical axis oscillatory agitator mounted in said spin basket;
a reversible motor selectively engageable with said agitator and said spin basket for oscillating said agitator when said motor is operated in a first direction and for rotating said basket when said motor is operated in a second opposite direction;
a control means for operating said appliance through a cycle of operation having an agitate portion and a spin portion;
a brake means for stopping rotation of said spin basket when said motor ceases rotation in said second direction, said brake means including
a pair of brake shoes having cam follower means thereon, each of said shoes connected at a common pivot point and being co-rotatable with said spin basket;
spring means normally biasing said shoes frictionally against a stationary member connected to the appliance to prevent rotation of said spin basket;
a cam rotatable between said brake shoes, said cam bearing against said follower means to overcome said spring bias of said shoes against the stationary member to allow rotation of said spin basket by said motor; and
an automatic rotational direction-responsive drive means selectively engageable with said cam for receiving rotational motion from said motor for co-rotating said cam, said brake shoes, and said spin basket when said motor is operated in said second direction, and including a means for disengaging said cam upon operation of said motor in said first direction.

2. In an automatic laundry appliance,
a rotatable spin basket for extracting liquid from a clothes load contained therein;
a reversible motor for driving said spin basket;
a transmission drivingly connecting said motor to said basket; and
a basket brake interconnected between said transmission and said spin basket comprising:
a pair of brake shoes each connected at a common pivot point and being co-rotatable with said spin basket;
spring means normally biasing said shoes frictionally against a stationary member connected to the appliance to prevent rotation of said spin basket;
a cam rotatable between said brake shoes, and cam follower means on said shoes and operable by said cam to overcome said bias of said shoes against the stationary member to allow rotation of said spin basket by said motor; and
a drive means selectively engageable with said cam for receiving rotational motion from said transmission to co-rotate said cam, said brake shoes, and said spin basket.

3. The laundry appliance of claim 2 wherein said cam follower means includes two cam followers a given distance apart and said cam has two similar cam surfaces, said surfaces increasing said given distance when said cam is operated to overcome said bias.

4. The laundry appliance of claim 2 wherein the cam follower means is an arm integrally formed on each of the brake shoes which abuts said cam.

5. The laundry appliance of claim 2 wherein the common pivot point of the brake shoes is a pivot pin mounted on a plate which is co-rotatably attached to the spin basket and which has tabs formed thereon for receiving each of the brake shoes when the brake shoes are not biased against the stationary member.

6. In an automatic laundry appliance,
means forming a clothes treatment zone including a rotatable spin basket within said zone for extracting liquid from clothes contained therein;
a motor for driving said basket;
a transmission drivingly connected between said motor and said basket; and
a basket brake interconnected between said transmission and said spin basket comprising:
a dish connected to a tub defining the treatment zone;
a vertical spin tube connected to said spin basket;
a horizontal plate connected to said spin tube for co-rotation therewith;
a pivot pin mounted on said plate;
a pair of brake members each pivotally connected to said pivot pin and each having a shoe surface biased into frictional engagement with said dish by a spring, each of said shoes having an arm in abutment with a cam surface;
a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and
a means attached to said cam selectively engageable with said transmission for drivingly rotating said cam, said brake members, said plate and said spin basket.

7. In an automatic laundry appliance,
a rotatable spin basket for extracting liquid from a clothes load contained therein;
a motor for driving said basket; and
a drive mechanism interconnected between said motor and said spin basket comprising:
a vertically disposed spin tube co-rotatably connected to said spin basket;
a spin gear disposed in a plane perpendicular to said spin tube and rotatable by said motor;
a spin collar in axial alignment with said spin tube having teeth thereon engaging said spin gear;
a clutch member clampingly attached to said spin collar for co-rotation therewith having a vertical circular outer wall defining an interior of said clutch member;
a frictional strip mounted on an interior of said vertical wall;
a radially expandable band concentrically disposed in the interior of said clutch member;
a frictional strip mounted on said band facing an interior of said vertical wall;
a biasing means spaced between ends of said expandable band maintaining said band and strip in frictional engagement with said interior wall;

a cam member surrounding said spin tube and freely rotatable with respect thereto, said cam member having an arm extending downwardly into the interior of said clutch member for engagement with said biasing means;

a cam integrally mounted on an upper portion of said cam member;

a plate mounted co-rotatably with and in a plane normal to said spin tube;

a pivot pin mounted on said plate;

a pair of rotatable brake members each pivotal about said pivot pin and each having an arm portion extending into abutment with said cam;

a dish immovably attached with respect to said spin basket to said appliance;

a second biasing means maintaining said brake members normally in frictional engagement with said dish; and a pair of receptacles on said plate for respectively receiving said brake members;

whereby rotation of said clutch member rotates said first biasing means which causes co-rotation of said cam member therewith to rotate said cam against said brake arms to move said brake members out of frictional engagement with said dish and into limiting engagement with said receptacles on said plate to rotate said clutch member, said cam member, said cam, said brake members, said plate, said spin tube and said spin basket as a unit.

8. The drive mechanism of claim 7 wherein means are provided to drive said spin gear only when said motor operates in a second direction of rotation which is opposite to a first direction of rotation.

9. The laundry appliance of claim 7 wherein the cam follower means is an arm integrally formed on each of the brake shoes which abuts said cam.

10. A spin basket brake for use in an automatic laundry appliance, said appliance having a dish connected to a tub defining a clothes treatment zone, a vertical spin tube connected to a spin basket within said tub, a horizontal plate connected to said spin tube and a pivot pin mounted on said plate, said brake comprising:

a pair of brake members each pivotally connectable to said pivot pin, each having a shoe surface for frictional engagement with said dish and a spring mounted surface for mounting a spring to bias said shoe surface against said dish, each of said shoes having an arm in abutment with a cam surface;

a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and a means attached to said cam selectively engageable with a transmission in said appliance for drivingly rotating said cam, said brake members, said plate and said spin basket.

11. An automatic laundry appliance comprising:

a cabinet;

a rotatable spin basket mounted in said cabinet for extracting liquid from a clothes load contained therein;

a reversible motor for driving said spin basket;

a transmission drivingly connecting said motor to said basket; and a basket brake interconnected between said transmission and spin basket comprising:

a pair of brake shoes each connected at a common pivot point and being co-rotatable with said spin basket;

spring means normally biasing said shoes frictionally against a stationary member connected to the appliance to prevent rotation of said spin basket;

a cam rotatable between said brake shoes, and cam follower means on said shoes and operable by said cam to overcome said bias of said shoes against the stationary member to allow rotation of said spin basket by said motor; and a drive means selectively engageable with said cam for receiving rotational motion from said transmission to co-rotate said cam, said brake shoes, and said spin basket.

12. An automatic laundry appliance comprising:

a cabinet;

means forming a clothes treatment zone inside said cabinet including a rotatable spin basket within said zone for extracting liquid from clothes contained therein;

a motor for driving said basket;

a transmission drivingly connected between said motor and said basket; and a basket brake interconnected between said transmission and spin basket comprising:

a dish connected to a tub defining the treatment zone;

a vertical spin tube connected to said spin basket;

a horizontal plate connected to said spin tube for co-rotation therewith;

a pivot pin mounted on said plate;

a pair of brake members each pivotally connected to said pivot pin and each having a shoe surface biased into frictional engagement with said dish by a spring, each of said shoes having an arm in abutment with a cam surface;

a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and a means attached to said cam selectively engageable with said transmission for drivingly rotating said cam, said brake members, said plate and said spin basket.

13. An automatic laundry appliance comprising:

a cabinet;

a rotatable spin basket contained in said cabinet for extracting liquid from a clothes load contained therein;

a motor for driving said basket; and a drive mechanism interconnected between said motor and said spin basket comprising:

a vertically disposed spin tube co-rotatably connected to said spin basket;

a spin gear disposed in a plane perpendicular to said spin tube and rotatable by said motor;

a spin collar in axial alignment with said spin tube having teeth thereon engaging said spin gear;

a clutch member clampingly attached to said spin collar for co-rotation therewith having a vertical circular outer wall defining an interior of said clutch member;

a frictional strip mounted on an interior of said vertical wall;

a radially expandable band concentrically disposed in the interior of said clutch member;

a frictional strip mounted on said band facing an interior of said vertical wall;

a biasing means spaced between ends of said expandable band maintaining said band and strip in frictional engagement with said interior wall;

a cam member surrounding said spin tube and freely rotatable with respect thereto, said cam member having an arm extending downwardly into the interior of said clutch member for engagement with said biasing means;

a cam integrally mounted on an upper portion of said cam member;

a plate mounted co-rotatably with and in a plane normal to said spin tube;

a pivot pin mounted on said plate;

a pair of rotatable brake members each pivotal about said pivot pin and each having an arm portion extending into abutment with said cam;

a dish immovably attached with respect to said spin basket to said appliance;

a second biasing means maintaining said brake members normally in frictional engagement with said dish; and a pair of receptacles on said plate for respectively receiving said brake members;

whereby rotation of said clutch member rotates said first biasing means which causes co-rotation of said cam member therewith to rotate said cam against said brake arms to move said brake members out of frictional engagement with said dish and into limiting engagement with said receptacles on said plate to rotate said clutch member, said cam member, said cam, said brake members, said plate, said spin tube and said spin basket as a unit.

14. An automatic laundry appliance having a dish connected to a tub defining a clothes treatment zone, a vertical spin tube connected to a spin basket within said tub, a horizontal plate connected to said spin tube and a pivot pin mounted on said plate, and a brake for said spin basket comprising:

a pair of brake members each pivotally connectable to said pivot pin, each having a shoe surface for frictional engagement with said dish and a spring mounted surface for mounting a spring to bias said shoe surface against said dish, each of said shoes having an arm in abutment with a cam surface;

a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and a means attached to said cam selectively engageable with a transmission in said appliance for drivingly rotating said cam, said brake members, said plate and said spin basket.

15. The laundry appliance of claim 1 wherein said cam follower means includes two cam followers a given distance apart and said cam has two similar cam surfaces, said surfaces increasing said given distance when said cam is rotated to overcome said spring bias.

16. The laundry appliance of claim 1 wherein the cam follower means is an arm integrally formed on each of the brake shoes which abuts said cam.

17. The laundry appliance of claim 1 wherein the common pivot point of the brake shoes is a pivot pin mounted on a plate which is co-rotatably attached to the spin basket and which has tabs formed thereon for receiving each of the brake shoes when the brake shoes are not biased against the stationary member.

18. An automatic laundry appliance comprising:

a cabinet;

means forming a clothes treatment zone inside said cabinet including a rotatable spin basket within said zone for extracting liquid from clothes contained therein;

a vertical axis oscillatory agitator mounted in said spin basket;

a motor for driving said basket and said agitator;

a transmission drivingly connected between said motor and said basket; and a basket brake interconnected between said transmission and said spin basket comprising:

a dish connected to a tub defining the treatment zone;

a vertical spin tube connected to said spin basket;

a horizontal plate connected to said spin tube for co-rotation therewith;

a pivot pin mounted on said plate;

a pair of brake members each pivotally connected to said pivot pin and each having a shoe surface biased into frictional engagement with said dish by a spring, each of said shoes having an arm in abutment with a cam surface;

a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and a means attached to said cam selectively engageable with said transmission for drivingly co-rotating said cam, said brake means, said plate and said spin basket in a first rotational direction and including a means for disengaging said cam upon reverse operation of said motor.

19. An automatic laundry appliance comprising:

a cabinet;

a rotatable spin basket contained in said cabinet for extracting liquid from a clothes load contained therein;

a vertical axis oscillatory agitator mounted in said spin basket;

a motor for driving said spin basket and said agitator; and a drive mechanism interconnected between said motor and said spin basket comprising:

a vertically disposed spin tube co-rotatably connected to said spin basket;

a spin gear disposed in a plane perpendicular to said spin tube and rotatable by said motor;

a spin collar in axial alignment with said spin tube having teeth thereon engaging said spin gear;

a clutch member clampingly attached to said spin collar for co-rotation therewith having a vertical circular outer wall defining an interior of said clutch member;

a radially expandable band concentrically disposed in the interior of said clutch member;

a frictional strip mounted on said band facing an interior of said vertical wall;

a biasing means spaced between ends of said expandable band maintaining said band and strip in frictional engagement with said interior wall;

a cam member surrounding said spin tube and freely rotatable with respect thereto, said cam member having an arm extending downwardly into the interior of said clutch member for engagement with said biasing means;

a cam integrally mounted on an upper portion of said cam member;

a plate mounted co-rotatably with and in a plane normal to said spin tube;

a pivot pin mounted on said plate;

a pair of rotatable brake members each pivotal about said pivot pin and each having an arm portion extending into abutment with said cam;

a dish immovably attached with respect to said spin basket to said appliance;

a second biasing means maintaining said brake members normally in frictional engagement with said dish; and a pair of receptacles on said plate for respectively receiving said brake members;

whereby rotation of said clutch member rotates said first biasing means which causes co-rotation of said cam member therewith to rotate said cam against said brake arms to move said brake members out of frictional engagement with said dish and into limiting engagement with said receptacles on said plate to rotate said clutch member, said cam member, said cam, said brake members, said plate, said spin tube and said spin basket as a unit.

20. The laundry appliance of claim 19 wherein means are provided to drive said spin gear only when said motor operates in a given direction of rotation.

21. The laundry appliance of claim 19 wherein the cam follower means is an arm integrally formed on each of the brake shoes which abuts said cam.

22. An automatic laundry appliance having a tub defining a clothes treatment zone, a dish member connected to said tub, a vertical axis oscillatory agitator mounted in said tub, a vertical spin tube connected to a spin basket within said tub, a horizontal plate connected to said spin tube, a reversible motor for driving said spin tube and said agitator, a pivot pin mounted on said plate, and a brake for said spin basket comprising:

a pair of brake members each pivotally connectable to said pivot pin, each having a shoe surface for frictional engagement with said dish and a spring mounted surface for mounting a spring to bias said shoe surface against said dish, each of said shoes having an arm in abutment with a cam surface;

a rotatable cam having said cam surface, said cam rotatable in a first direction to push said arms of said brake members apart to cause said brake shoes to move out of frictional engagement with said dish, and rotatable in a second direction to allow said spring to bias said shoes into frictional engagement with said dish; and a rotational direction-responsive means attached to said cam selectively engageable with a transmission in said appliance for drivingly rotating said cam, said brake members, said plate and said spin basket, said direction-responsive means including a means for disengaging said cam upon reverse operation of said motor.

* * * * *